US007014425B2

(12) United States Patent
Havel et al.

(10) Patent No.: US 7,014,425 B2
(45) Date of Patent: Mar. 21, 2006

(54) LOW PRESSURE FAN WITH Y-SHAPED BLADES

(75) Inventors: Brian Havel, London (CA); Bonifacio Castillo, London (CA)

(73) Assignee: Siemens VDO Automotive Inc., Chatham (CA)

( * ) Notice: Subject to any disclaimer, the term of this patent is extended or adjusted under 35 U.S.C. 154(b) by 120 days.

(21) Appl. No.: 10/838,063

(22) Filed: May 3, 2004

(65) Prior Publication Data

US 2005/0129518 A1 Jun. 16, 2005

Related U.S. Application Data

(60) Provisional application No. 60/529,319, filed on Dec. 12, 2003.

(51) Int. Cl.
*F04D 29/38* (2006.01)

(52) U.S. Cl. ..... 416/169 A; 416/189; 416/195; 416/227 R; 416/231 B

(58) Field of Classification Search ..... 416/227 R, 416/231 R, 231 B, 169 A, 189, 227 A, 194, 416/195, 196 R, 196 A
See application file for complete search history.

(56) References Cited

U.S. PATENT DOCUMENTS 1,345,055 A * 6/1920 Willour ..... 416/194
5,221,187 A * 6/1993 Lorea et al. ..... 416/189

* cited by examiner

*Primary Examiner*—Edward K. Look
*Assistant Examiner*—Richard A. Edgar

(57) ABSTRACT

A fan 10 includes a central hub 14, an outer ring structure 18, and a plurality of fan blades 12. Each blade is of generally Y-shaped configuration having first and second separate branches 12*a*, 12*b*, respectively, coupled to the hub 14 and merging with a third branch 12*c*. The third branch 12*c* is coupled to the ring structure 18 at a tip 16 of the blade 18.

10 Claims, 2 Drawing Sheets

LOW PRESSURE FAN WITH Y-SHAPED BLADES

This application is based on U.S. Provisional Application No. 60/529,319, filed on Dec. 12, 2003, and claims the benefit thereof for priority purposes.

FIELD OF THE INVENTION

The invention relates to fans for automotive applications and, more particularly, to a fan that has blades that maximize strength and minimize deflection due to a Y-shaped configuration of each blade.

BACKGROUND OF THE INVENTION

Conventional fans have the purpose of moving a substance of gaseous state. A multiple number of blades fixed rigidly to the hub and surrounded by a ring produce airflow when rotating. The usual problems with fans, especially of large size, are (1) axial deflection (2) the stress level under centrifugal loading. Axial deflection of the fan is undesirable for reasons of interference with other components as well as for aerodynamic and aeroacoustic reasons. High blade stresses can lead to catastrophic failure of the fan. In typical configurations, to add strength to the fan, the chord length is increased to fix the blade tip to a surrounding ring that joins the blade tips. These configurations add material to the outermost radial sections of the blade in order to achieve increased strength. However, the added mass contributes to excessive axial deflection.

There is a need to provide a fan that minimizes deflection and maximizes strength by eliminating high stresses at critical areas and that combines efficient aerodynamic and aeroacoustic performance with the structural performance.

SUMMARY OF THE INVENTION

An object of the invention is to fulfill the need referred to above. In accordance with the principles of the present invention, this objective is achieved by providing a fan having a central hub, an outer ring structure, and a plurality of fan blades. Each blade is of generally Y-shaped configuration having first and second separate branches coupled to the hub and merging with a third branch. The third branch is coupled to the ring structure at a tip of the blade. A dimensionless radius (r/R) is defined from a center of the hub, wherein r/R=0, extending radially outwardly where a tip of each blade is located at r/R=1, and an outer edge of the hub is defined as R1 and is located at a range of 0.2<r/R<0.5, and the first and second branches merge at a location defined as R2 into the third branch at a range of 1.2*R1<r/R<0.7. In addition, between R1 and R2, in section, a leading edge tip of the second branch is set a certain dimension higher than that of the first branch.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
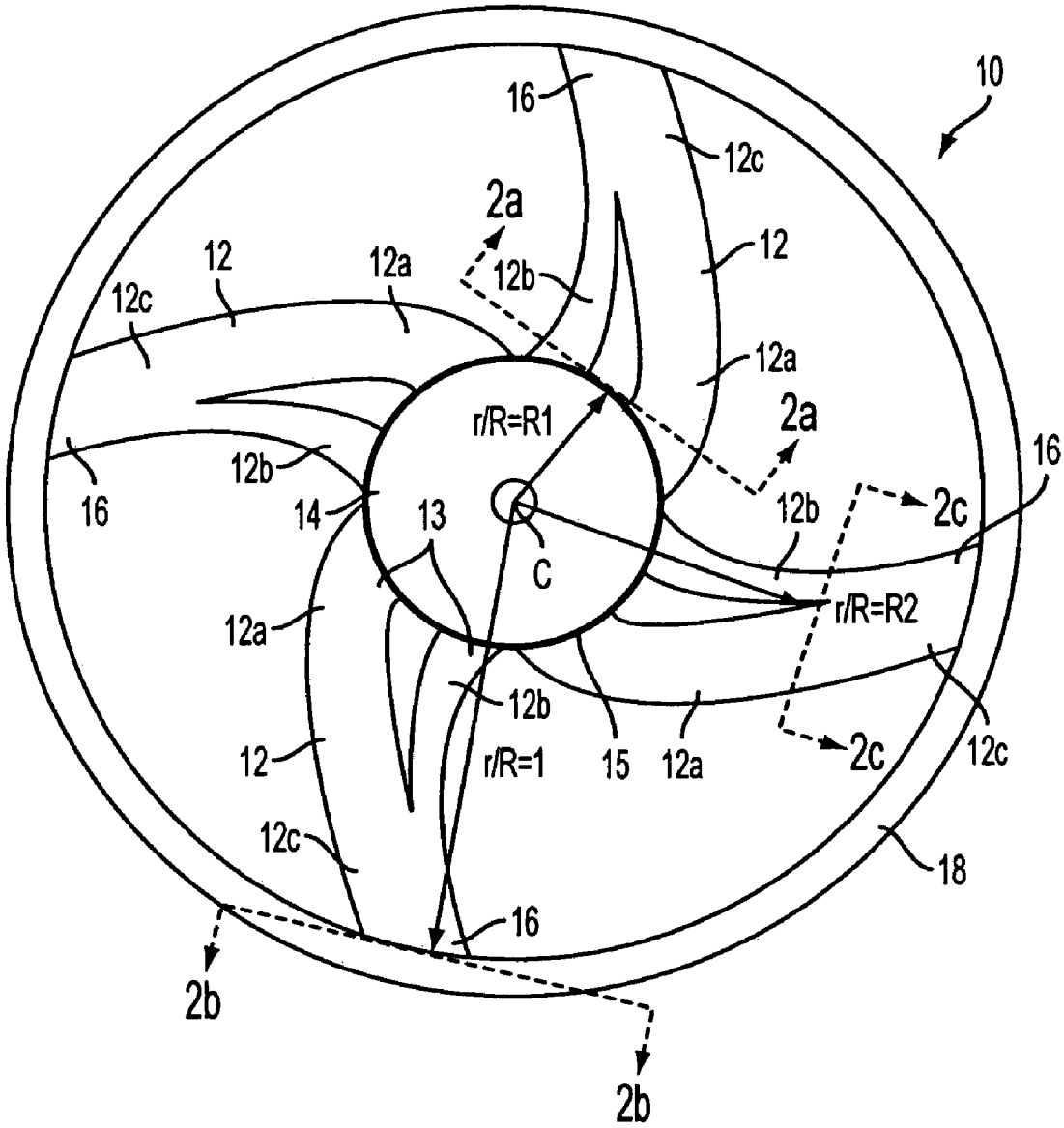
FIG. 1 is plan view of a fan having Y-shaped blades provided in accordance with the invention.

With reference to FIG. 1, a fan 10 is shown for moving air with multiple blades 12. The fan 10 is preferably used in automotive applications, especially those with high flow rate requirements and those where the fan has to withstand stresses due to rotations at high RPM levels.

The blades 12 extend from a root portion 13, joined with a central hub 14, radially outwardly where blade tips 16 of the blades 12 are coupled to an outer ring structure 18. The hub 14 and ring structure 18 are concentric.

A dimensionless radius (r/R) is defined from the center C of the hub 14 (this point is r/R=0) radially outwardly, where the tip 16 of each blade 12 (not including the ring structure 18) is r/R=1 as shown in FIG. 1. An outer edge 15 of the hub 14 is defined as r/R=R1 and lies in the range of 0.2<r/R<0.5.

Figure 2A:
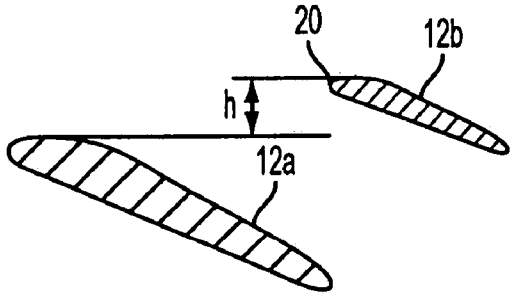
FIG. 2*a* is a cross-section of a blade taken along the line 2*a*—2*a* at radius R1 of FIG. 1.
Figure 2B:
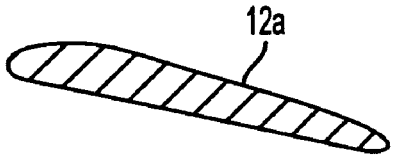
FIG. 2*b* is a cross-section of a blade taken along the line 2*b*—2*b* at r/R=1 of FIG. 1.

Each blade has a Y-shape defined by a first branch 12*a* and a separate second branch 12*b*, each joined to a third branch 12*c*. Thus, on the radius R1, the dual branches 12*a*, 12*b* of the blade are attached to the hub 14, whereas at r/R=1, the third branch 12*c* of the blade 12 is attached to the ring structure 18. FIG. 2*a* shows the cross-section of a blade 12 at radius R1, FIG. 2*b* shows the cross-section of a blade 12 at r/R=1. In the embodiment, four evenly-spaced blades are provided, but fewer than four or more than four blades can be employed.

Figure 2C:
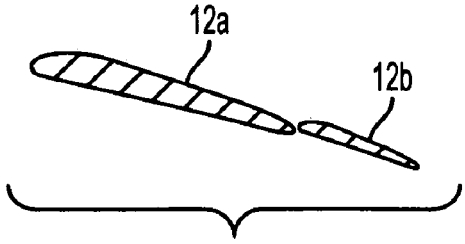
FIG. 2*c* is a cross-sectional view of a blade taken along the line 2*c*—2*c* at R2 of FIG. 1.

The dual branches 12*a*, 12*b* of each blade 12 merge together at radius R2 to form the third branch 12*c*. This point lies in the range 1.2*R1<r/R<0.7. The cross-section of the blade at R2 is shown in FIG. 2*c*.

Between R1 and R2, in section, a leading edge tip 20 of the second branch 12*b* is set higher than that of the first branch by a height "h" as depicted in FIG. 2*a*.

The blade configuration, in addition to features noted above, can incorporate dihedral geometry of the blade as well as unevenly spaced blades.

The fan 10 is efficient in the high volume forced air operation, which makes it suited for high-speed automobile applications. In addition, the fan 10 has a high structural integrity due to its stress concentration, occurring on a neutral axis, coinciding with a space between the bifurcated branches 12*a*, 12*b*. Furthermore, the addition of the second branch 12*b* acts to help prevent flow separation on the blade, making the blade more efficient and quieter.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fan comprising:

a central hub, an outer ring structure, and a plurality of fan blades, each blade being of generally Y-shaped configuration having first and second separate branches coupled to the hub and merging into a single third branch, only the third branch being coupled to the ring structure at a tip of the blade.

2. The fan of claim 1, wherein a dimensionless radius (r/R) is defined from a center of the hub, wherein r/R=0, extending radially outwardly where a tip of each blade is located at r/R=1, and an outer edge of the hub is defined as R1 and is located at a range of 0.2<r/R<0.5, and the first and second branches merge at a location defined as R2 into the third branch at a range of 1.2*R1<r/R<0.7.

3. The fan of claim 2, wherein between R1 and R2, in section, a leading edge tip of the second branch is set a dimension higher than that of the first branch.

4. The fan of claim 1, wherein four blades are provided.

5. The fan of claim 4, wherein the blades are evenly spaced about the hub.

6. The fan of claim 1, wherein the hub and ring structure are concentric.

7. A fan comprising:

a central hub, an outer ring structure, and a plurality of fan blades, each blade being of generally Y-shaped configuration having first and second separate branches coupled to the hub and merging into a single third branch, only the third branch being coupled to the ring structure at a tip of the blade, wherein a dimensionless radius (r/R) is defined from a center of the hub, wherein r/R=0, extending radially outwardly where a tip of each blade is located at r/R=1, and an outer edge of the hub is defined as R1, and the first and second branches merge at a location defined as R2 into the third branch, wherein between R1 and R2, in section, a leading edge tip of the second branch is set a dimension higher than that of the first branch.

8. The fan of claim 7, wherein four blades are provided.

9. The fan of claim 8, wherein the blades are evenly spaced about the hub.

10. The fan of claim 7, wherein the hub and the ring structure are concentric.

* * * * *